United States Patent [19]

Angott et al.

[11] Patent Number: 4,749,917

[45] Date of Patent: Jun. 7, 1988

[54] TWO-TONE DIMMER CIRCUIT

[76] Inventors: Paul G. Angott, 457 Hurst, Troy, Mich. 48098; Keith D. Jacob, 2321 S. Circle Dr., Ann Arbor, Mich. 48103

[21] Appl. No.: 860,300

[22] Filed: May 5, 1986

[51] Int. Cl.[4] ..... H05B 37/02

[52] U.S. Cl. ..... 315/307; 315/DIG. 4; 315/291; 315/199; 315/DIG. 7

[58] Field of Search ..... 315/DIG. 4, DIG. 5, 315/307, 291, 175, 199, 219, 220, 194, DIG. 7

[56] References Cited

U.S. PATENT DOCUMENTS

| | | | |
|---|---|---|---|
| 4,087,702 | 5/1978 | Kirby et al. | 315/194 |
| 4,353,009 | 10/1982 | Knoll | 315/220 |
| 4,523,131 | 6/1985 | Zansky | 315/219 |
| 4,580,080 | 4/1986 | Smith | 315/307 |

*Primary Examiner*—David K. Moore
*Assistant Examiner*—Michael Razavi
*Attorney, Agent, or Firm*—Reising, Ethington, Barnard, Perry & Milton

[57] ABSTRACT

The circuit includes a super regenerative detector (12) for receiving a modulated radio frequency signal from a transmitter. The output of the super regenerative detector is amplified and sent into a high frequency interpreter circuit (16, 18, 20) which de-modulates the signal creating an output of low frequency equal to the consecutive pulses frequency. The low frequency signal is received by a low frequency interpreter circuit (22, 24, 26) which outputs a digital signal of a single duration which is received by a counter circuit (30). The counter circuit (30) controls the firing of a triac (T1) to create lighting conditions of on, off and dimming.

20 Claims, 1 Drawing Sheet

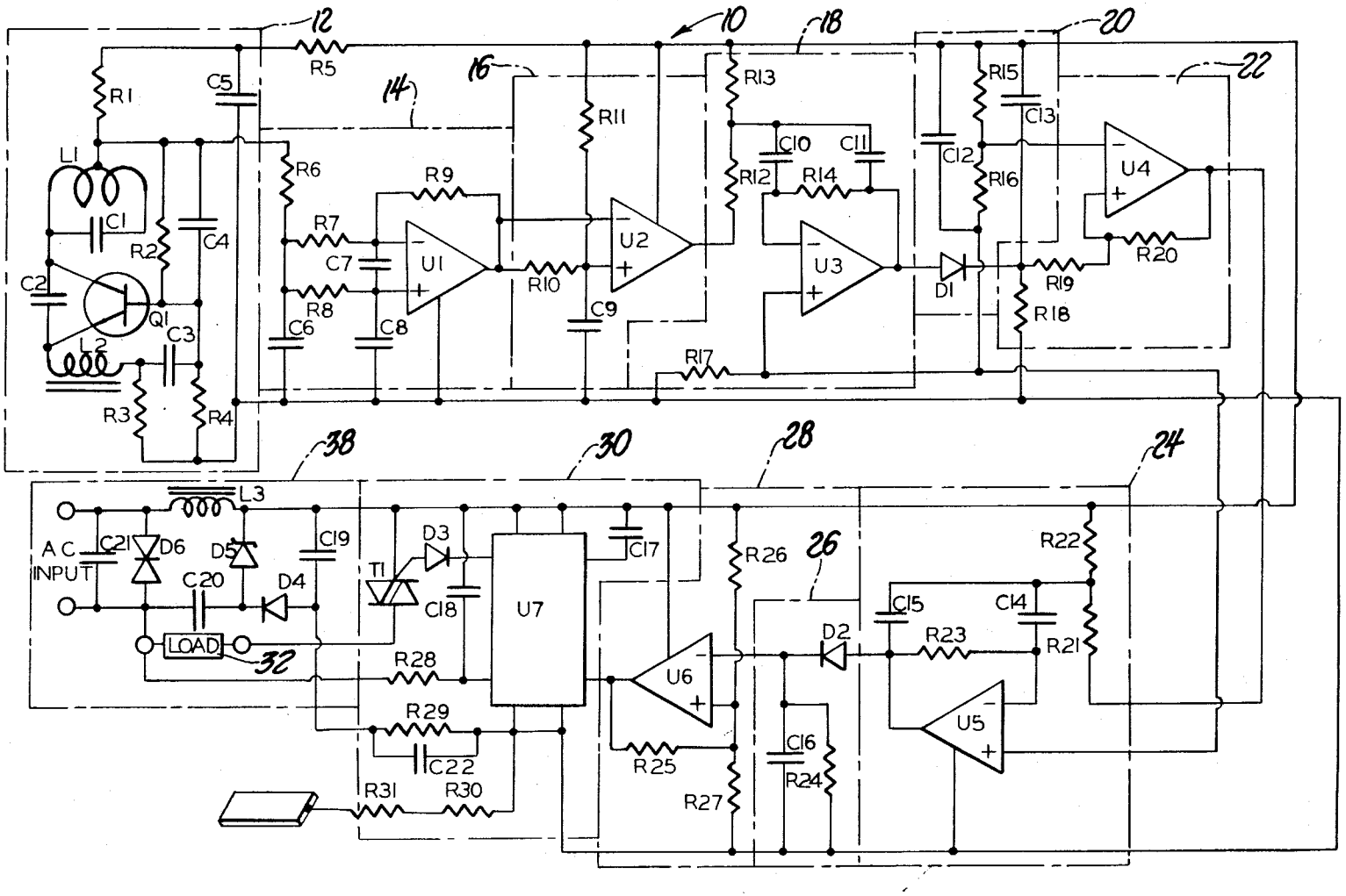
10
12
14
16
18
20
22
24
26
28
30
32
38
U1
U2
U3
U4
U5
U6
U7
Q1
T1
D1
D2
D3
D4
D5
D6
L1
L2
L3
LOAD
AC INPUT

TWO-TONE DIMMER CIRCUIT

TECHNICAL FIELD

The subject invention relates to remotely controlled dimmer circuits which are utilized with a light.

BACKGROUND ART

Dimmer circuits are extensively utilized in devices requiring a variable amount of power. This is typically accomplished by either a manual potentiometer switch that is manually turned by the operator, or a remotely controlled circuit. In the manual potentiometer, the operator is required to be at the location of the switch. Remotely controlled circuits use counters to count the number of pulses to activate a relay to vary the amount of power delivered to the load. One such circuit receives a single radio frequency signal from a transmitter. The signal is amplified, limited, filtered and detected. The output of the circuit is a digital signal which is sent into a counter means. The counter reacts to the duration of the digital signal which changes the firing phase of a triac to illuminate the light to the requested lighting condition. An inadequacy of this circuit is that the circuit uses a single frequency which allows for error from noise and other transmitters by interfering with the circuit function.

SUMMARY OF THE INVENTION

The subject invention relates to a dimmer control circuit for respectively turning on, off, and dimming a light. The circuit contains a super regenerative detector for receiving a modulated radio frequency signal within a predetermined frequency range from a transmitter. A light control means connects between a light and an electrical power outlet and is responsive to the detector for independently controlling the electrical power supplied to the light in a series of stepped levels in response to the duration of the modulated radio frequency signal detected by the detector. The circuit is characterized by the light control means including a counter circuit and high frequency and low frequency interpreter circuits in series for producing a digital signal to drive the counter circuit to adjust the phase angle of a pulse to control the amount of power supplied to the light.

The subject invention solves the inadequacy of the prior art of interference by noise or other transmitters, by having the circuit receive a two tone modulated radio frequency signal to ensure the circuit reacts only when the transmitter is transmitting.

BRIEF DESCRIPTIONS OF THE DRAWINGS

Other advantages of the present invention will be readily appreciated as the same becomes better understood by reference to the following detailed description when considered in connection with the accompanying drawing which is a schematic of the receiver portion of a preferred circuit of the subject invention.

DESCRIPTION OF THE PREFERRED EMBODIMENT

A remotely controlled dimmer circuit is generally shown at 10 in the drawing. The circuit 10 supplies power to an electrical device or load requiring electrical power from a constant source. The circuit can be used with any device requiring power from a conventional electrical power source for electrically supplying power to the electrical load in response to a predetermined radio signal. A modulated radio frequency signal sent from a transmitter and is detected and interpreted creating a digital signal whose pulse duration is transformed into the phase firing to illuminate a light or load.

A super regenerative detector 12 receives the modulated radio frequency signal which is within a predetermined frequency range from a transmitter. The predetermined frequency range is determined by the value of components used as indicated hereinafter. The super regenerative detector 12 includes a coupling inductor L1 connected in parallel with a capacitor C1 to define a tuned circuit. A capacitor C2 connects the collector and emitter of a transistor Q1. A resistor R2 and a capacitor C4 are in parallel which are connected to the base of the transistor Q1. The collector of the transistor Q1 is connected to an inductor L2 acting as an isolation choke which is connected to a capacitor C3 between two parallel resistors R3, R4. A resistor R1 taps the inductor L1. A resistor R5 and capacitor C5 connects the circuit to the supply power line for setting a time constant.

The signal from the super regenerative detector 12 is sent into an audio amplifier 14 to amplify the signal to a magnitude which can be interpreted. A operational amplifier U1 is biased by three resistors R6, R7, R8 which are connected to the inverting and noninverting inputs. The inputs are separated by a capacitor C7. The operational amplifier U1 has inverting feedback through a resistor R9. Two parallel capacitors C6, C8 connect the audio amplifier 14 to the power line for setting a time constant.

The amplified signal from the audio amplifier 14 is sent into a high frequency interpreter circuit 16, 18, 20. The high frequency interpreter circuit transforms the amplified, modulated radio frequency into a low frequency signal which has low frequency pulse durations equal to the duration of consecutive pulses of the high frequency input signal. The high frequency interpreter circuit includes a limiter 16, a high tone filter 18, and a detector 20. The limiter 16 adjust the magnitude of the signal to be within a predetermined range. The components of the limiter 16 include an operational amplifier U2 with an inverting input connected to the output of the audio amplifier 14 and the noninverting input is biased by two resistors R10, R11 which is connected to the output of the audio amplifier 14. A capacitor C9 connects the circuit to the power line.

The high tone filter 18 filters out frequencies above a predetermined allowable frequency to eliminate noise and miscellaneous transmitted signals the super regenerative detector 12 picks up. The high tone filter 18 includes an operational amplifier U3 with inverting feedback to configure the filter which has a resistor R14 connected between two parallel capacitors C10, C11. The capacitors C10, C11 are connected to the output of the limiter 16 through two biasing resistors R12, R13. A resistor R17 biases the noninverting input of the operational amplifier U3.

The detector 20 creates a signal of a signal duration equal to the duration of the low frequency pulses indicative of the amount of dimming control. The detector 20 acts as a peak smoothing circuit which charges a capacitor C13, which remains charged until the consecutive high frequency pulses have passed. The capacitor C3 will output a high signal for the duration of consecutive high frequency pulses. The detector includes a diode D1 connected to the output of the high tone filter 18 which is connected to the capacitor C13.

The signal from the high frequency interpreter circuit 16, 18, 20 is sent to the low frequency interpreter circuit 22, 24, 26. The low frequency interpreter circuit 22, 24, 26 transforms the output of the high frequency interpreter circuit 16, 18, 20 into a digital signal of a pulse equal in duration of the low frequency input signal which is proportional to the amount of dimming requested. The low frequncy interpreter circuit includes a limiter 22, a low tone filter 24, and a detector 26.

The limiter 22 is connected to the output of the high frequency detector 20 and is used for setting the signal magnitude within a predetermined range. The limiter 22 includes an operational amplifier U4 with noninverting feedback which is connected through three resistors R18, R19, R20 to the diode D1 of the detector 20. The inverting input is biased by a pair of resistors R15, R16 and a capacitor C12.

The low tone filter 24 receives the output from the limiter 22 and is used for filtering out frequencies below a predetermined allowable frequency to ensure that the signal received is from the transmitter. The low tone filter 24 includes an operational amplifier U5 with biasing resistors R21, R22. The operational has inverting feedback through resistor R23 and parallel capacitors C14, C15.

A detector 26 is connected to the output of the low tone filter 24 and is used for creating a single of a signal duration equal to the duration of the low frequency pulses indicative of the amount of dimming control. The detector 26 includes a diode D2 connected to the output of the low tone filter 24 and connected to a capacitor C16 and resistor R24 in parallel.

The light control means also includes a threshold detector 28 which receives the signal from the detector 26 of the low frequency interpreter circuit to ensures that the magnitude of the signal is within the predetermined range for driving the phase firing of the power to the load. The threshold detector includes an operational amplifier U6 biased by two resistors R26, R27 with noninverting feedback through resistor R25. The inverting input is connected to the diode D2 of said detector 26 of said low frequency interpreter circuit.

A counter circuit 30 receives the digital signal from the threshold detector 28. The counter circuit 30 includes a triac T1 and an integral circuit chip U7. The integrated circuit chip U7 acts as a counter reacting from the duration of the signal coming from the threshold detector 28 which counts based on time intervals which establishes the phase of firing of the triac to a illuminate the light to the requested lighting condition. A diode D3 is connected between the integrated circuit chip U7 and the triac T1 for driving the gate and phase controlling the triac T2 to illuminate the light or load 32 to the proper dimming condition.

The light control means also includes a touch control means 34 connected directly to the counter circuit 30 for changing the light conditions by touching a metal plate 36 of the lamp. The integral circuit chip U7 reacts from the duration of the touch. The touch dimmer circuit 34 includes a pair of large resistors R30, R31 connected between a pin of the integrated circuit chip U7 and a metal plate 36 designed for human contact. A resistor R29 and a capacitor C22 are in shunt which are connected between a power supply circuit 38 and a pin of the integral chip U7.

A power supply circuit 38 is connected between the counter circuit 30 and the power leads for supplying power to the circuit and to the light or load 32 through the counter circuit 30. The power supply circuit includes a resistor R28 and a capacitor C18 interconnect the power output and counter circuit 30 for a counter reset. A capacitor C17 connects to the integrated circuit chip U7 to prevent triggering of the counter circuit U7. A capacitor C21 interconnects the power input to prevent shorting. A blocking diode D6 interconnects the power input leads to protect the circuit 30 against voltage surges from a constant power source. A zener diode D5 and a capacitor C20 connects the power input to the inductor L3 to limit the charge stored in the inductor L3. A diode D4 and capacitor C19 connect the power supply circuit 38 to ground. Thus,a first duration, typically less than on second, of the radio frequency signal will energize the counter circuit 30 by having the integrated circuit chip U7 fire a gate pulse to the triac T1 causing the triac T1 to conduct. The integrated circuit chip U7 will hold the previous power magnitude level in memory. So, once the counter circuit is energized, a longer duration of the radio frequency signal will cause the counter circuit 30 to count up or down and increase or decrease the amount of power supplied to the light or load 32. Another short duration pulse will deenergize the counter circuit 30 and cut the power to the light or load 32.

By way of example, and certainly not way of limitation, the preferred embodiment of the circuit illustrated may include the following components.

| Name | Value |
|---|---|
| | Resistors |
| R1 | 4.7K |
| R2 | 10K |
| R3 | 470 |
| R4 | 3.3K |
| R5 | 10 L |
| R6 | 4.7K |
| R7 | 10K |
| R8 | 10K |
| R9 | 1 m |
| R10 | 10K |
| R11 | 1 M |
| R12 | (a)200K, (b)270K, (c)330K |
| R13 | (a)1.05K, (b)1.33K, (c)1.74K |
| R14 | (a)422K, (b)536K, (c)681K |
| R15 | 22K |
| R16 | .8K |
| R17 | 27K |
| R18 | 220K |
| R19 | 100K |
| | M |
| R21 | 390K |
| R22 | 3.32K |
| R23 | 806K |
| R24 | 100K |
| R25 | 2.2 M |
| R26 | 27K |
| R27 | 47K |
| R28 | 1.5 M |
| R29 | 330 |
| R30 | 330 |
| | Capacitors |
| C1 | 3.3 p |
| C2 | 5 p |
| C3 | 1 n |
| C4 | 100 p |
| C5 | 100 mfd/10 v |
| C6 | 4.7 n |
| C7 | 1 n |
| C8 | 10 mfd/25 v |
| C9 | 10 mfd/25 v |
| C10 | 4.7 n |

-continued

| | |
|---|---|
| C11 | 4.7 n |
| C12 | 10 mfd/25 v |
| C13 | 22 n |
| C14 | 22 n |
| C15 | 22 n |
| C16 | 1 mfd/25 v |
| C17 | 4.7 n |
| C18 | 47 n |
| C19 | 470 p |
| C20 | 100 mfd/25 v |
| C21 | .68 mfd/250 v |
| C22 | .1 mfd/250 v |

| Name | Type |
|---|---|
| | Diodes |
| D1 | 1N4148 |
| D2 | 1N4148 |
| D3 | 1N4004 |
| D4 | 1N4004 |
| D5 | 1N 4744A |
| D6 | MOV |
| | Integrated Circuit Chips |
| U1, U2, U3, U4 | LM324 |
| U5, U6 | LM358 |
| U7 | LSI 7232 |
| | Transistors |
| Q1 | NSCITD.9018 |
| | Inductors |
| L1 | 3 loops, ¼ D × ¾ paper form, ¼ D × ⅞ slug |
| L2 | .47 MH |
| L3 | 80 MH |
| | Triac |
| T1 | teccor Q4006 L4 |

As shown in the component list the resistors R12, R13, and R14, can have different values as indicated by (a), (b), and (c). By using either the first set, second set, or third set of values, a different frequency will be detected from the transmitter. The first set of values will detect a signal of a 147.5 microsecond high frequency radio signal. The second and third set will detect a 187.7 microsecond and a 241.1 microsecond high frequency radio signal respectively. The low frequency signal is set at 11.83 milliseconds.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in anyway limiting, the invention may be practiced otherwise than as specifically described.

What is claimed is:

1. A dimmer control circuit responsive to a remote radio signal transmitter for respectively turning on, off and dimming a light, said circuit comprising; a super regenerative detector (12) for receiving a modulated radio frequency signal within a predetermined frequency range from the transmitter, light control means (10) connected between the light and an electrical power outlet and responsive to said detector (12) for independently controlling the electrical power supplied to the light in a series of stepped levels in response to the duration of said modulated radio frequency signal detected by said detector means, said circuit characterized by said light control means including high frequency (16, 18, 20) and low frequency (22, 24, 26) interpreter circuits in series responsive to said detector (12) for producing a digital signal, and a counter circuit (30) for establishng said stepped level from the duration of said digital signal to adjust the phase angle of a pulse to control the amount of power supplied to the light at said stepped level.

2. A circuit as set forth in claim 1 wherein said high frequency interpreter circuit (16, 18, 20) is connected between said super regenerative detector (12) and said low frequency interpreter circuit (22, 24, 26) for outputing a signal of low frequency having pulse duration equal to the duration of consecutive pulses of the high frequency input signal.

3. A circuit as set forth in claim 2 wherein said low frequency interpreter circuit (22, 24, 26) is connected between said high frequency interpreter circuit (16, 18, 20) and said counter circuit (30) for outputing said digital signal of a pulse equal in duration of the low frequency input signal which is proportional to the amount of dimming requested.

4. A circuit as set forth in claim 3 wherein said counter circuit (30) is connected to said low frequency interpreter circuit (22, 24, 26) and includes a triac (T1) and an integral circuit chip, said integral circuit chip (U7) acts as a counter proportional to the duration of the signal coming from said low frequency interpreter circuit (22, 24, 26) to establish the phase of firing of said triac (T3) to illuminate the light (32) at the requested lighting condition.

5. A circuit as set forth in claim 4 wherein said light control means includes a touch control means (34) connected to said counter circuit (30) for directly changing the light condition by touching a metal plate (36) on the lamp.

6. A circuit as set forth in claim 4 wherein said light control means includes an audio amplifier (14) connected between said super regenerative detector (12) and said high frequency interpreter (16, 18, 20) for amplifying the signal.

7. A circuit as set forth in claim 6 wherein said light control means includes a threshold detector (28) connected between said counter circuit (30) and said low frequency interpreter circuit (22, 24, 26) for ensuring that the magnitude of the signal is within a predetermined range for interpretation.

8. A circuit as set forth in claim 7 wherein said high frequency interpreter includes a limiter (16) for setting the signal magnitude within a predetermined range, a high tone filter (18) for filtering out frequencies above a predetermined allowable frequency, and a detector (20) for averaging the peaks of the high frequency to result in a low frequency signal with a pulse duration equal to the consecutive pulses of high frequency signal.

9. A circuit as set forth in claim 8 wherein said low frequency interpreter includes a limiter (22) for setting the signal magnitude within a predetermined range, a low tone filter (24) for filtering out frequencies below a predetermined allowable frequency (26), and a detector to for creating a signal of a single duration equal to the duration of the low frequency pulses indicative of the amount of dimming control.

10. A circuit as set forth in claim 9 wherein said light control means includes a power supply circuit (38) connected between said counter circuit (30) and the power leads for supplying power to said circuit and to the light (32) through said counter circuit.

11. A circuit as set forth in claim 10 wherein said super regenerative detector (12) includes a coupling inductor (L1) connected in parallel with a capacitor (C1), a capacitor (C2) connects the collector and emitter of a transistor (Q1), a resistor (R2) and a capacitor (C4) are in parallel which is connected to the base of the transistor (Q1), the collector of said transistor (Q) is connected to an inductor (L2) which is connected to a capacitor (C3) which is between two parallel resistors (R3, R4).

12. A circuit as set forth in claim 11 wherein said audio amplifier (14) includes an operational amplifier (U1) biased by three resistors (R6, R7, R8) connected to the inverting and noninverting inputs, said inputs separated by a capacitor (C9), said operational amplifier having inverting feedback through a resistor (R9).

13. A circuit as set forth in claim 12 wherein said limiter (16) of said high frequency interpreter circuit includes an operational amplifier (U2) with an inverting input connected to the output of the audio amplifier (14) and said noninverting input biased by a resistor (R10) and connected to the output of the audio amplifier (14), said high tone filter (18) includes an operational amplifier (U3) with inverting feed back to configure the filter which has a resistor (14) connected between two parallel capacitors (C10, C11) which are connected to the output of said limiter (16), and said detector (20) of said high frequency interpreter circuit includes a diode (D1) connected to te output of said high tone filter (18) which is connected to a capacitor (C13).

14. A circuit as set forth in claim 13 wherein said limiter (22) of said low frequency interpreter circuit includes an operational amplifier (U4) with noninverting feedback through a resistor (R20), said noninverting feedback is biased by two resistors (R18, R19) to the diode (D1) of the detector (20), said inverting input is biased by a pair of resistors (R15, R16) and a capacitor (C12), said low tone filter (24) includes an operational amplifier (U5) with inverting feedback through a resistor (R23) and parallel capacitors (C14, C15) which connects to the output of the limiter (22), with biasing resistors (R21, R22) connected to the inverting input, and said detector (26) of said low frequency interpreter circuit includes a diode (D2) connected to the output of said low tone filter (24) and connected to a capacitor (C16) and resistor (R24).

15. A circuit as set forth in claim 14 wherein said threshold detector (28) includes an operational amplifier (U6) with noninverting feedback through a resistor (R25), the inverting input is connected to the diode (D2) of said detector (26) of said low frequency interpreter circuit and the noninverting input is biased by a resistor (R27).

16. A circuit as set forth in claim 15 wherein said counter circuit includes an integrated circuit chip (U7) connected to the output of said threshold detector (28), and the output of said counter circuit is connected through a diode (D3) to said triac (T1).

17. A circuit as set forth in claim 16 wherein said power supply circuit (38) includes a resistor (R28) and capacitor (C8) connecting the power output leads and counter circuit (30), a capacitor (C17) connected to the integrated circuit chip (U7), a blocking diode (D6) and capacitor (C21) connected across the power leads, a zener diode (D5) and capacitor (C20) connected to an inductor (L3) and a diode (D4) and capacitor (C19) connected to ground.

18. A circuit as set forth in claim 17 wherein said light control means includes a touch control means (34) connected between said integral circuit chip (U7) and a metal touch plate (36) for direct control of said counter circuit (30) for responding to the duration of a digital signal.

19. A circuit as set forth in claim 18 wherein said touch dimmer includes a pair of large resisters (R30, R31) connected between a pin of said integrated circuit chip (U7) and a metal plate (36) designed for human contact, and a resistor (R29) and capacitor (C22) in shunt connected between said power supply circuit (38) and a pin of said integral circuit chip (U7).

20. A dimmer control circuit responsive to a remote radio signal transmitter for respectively turning on, off and dimming a light, said circuit comprising; a super regenerative detector (12) for receiving a modulated radio frequency signal within a predetermined frequency range from the transmitter, a light control means (10) connected between the light and an electrical power outlet and responsive to said detector (12) for independently controlling the electrical power supplied to the light in a series of stepped levels in response to the duration of said modulated radio frequency signal detected by said detector means, said circuit characterized by said light control means including a counter circuit (30) and high frequency interpreter circuit (16, 18, 20) connected to said super regenerative detector (12) for outputing a signal of low frequency having a pulse duration equal to the duration of consecutive pulses of the high frequency input signal, and low frequency interpreter circuit (22, 24, 26) connected between said high frequency interpreter circuit (16, 18, 20) and said counter circuit (30) for outputing a digital signal of a pulse equal in duration to the low frequency input signal which is proportional to the amount of dimming requested.

* * * * *